US006206725B1

(12) United States Patent
Wu

(10) Patent No.: US 6,206,725 B1
(45) Date of Patent: Mar. 27, 2001

(54) CONNECTOR ASSEMBLY

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/444,115

(22) Filed: Nov. 22, 1999

(30) Foreign Application Priority Data

Aug. 13, 1999 (TW) ..... 88213773

(51) Int. Cl.[7] ..... H01R 13/502
(52) U.S. Cl. ..... 439/541.5; 439/676; 439/607
(58) Field of Search ..... 439/676, 541.5, 439/607, 609, 701

(56) References Cited

U.S. PATENT DOCUMENTS 5,531,612 * 7/1996 Goodall et al. ..... 439/676
5,562,507 * 10/1996 Kan ..... 439/676
5,639,267 * 6/1997 Loudermilk ..... 439/676
6,019,631 * 2/2000 Chen ..... 439/676

* cited by examiner

*Primary Examiner*—Gary F. Paumen
(74) *Attorney, Agent, or Firm*—Wei Te Chung

(57) ABSTRACT

An electrical connector assembly comprises an outer shield member and a plurality of insert subassemblies received in the outer shield member. A shielding system is provided to include the outer shield member, a plurality of rear shield members attached to the corresponding insert subassemblies, and a plurality of inner shield members respectively fixed in the corresponding insert subassemblies. The outer shield member defines a plurality of accommodating chambers arranged in upper and lower rows for receiving the insert subassemblies. Each insert subassembly includes a base member, a lower contact module containing a plurality of first contacts, the inner shield member, an upper contact module containing a plurality of second contacts, a positioning member and a rear shield member. Each inner shield member is positioned between the first contacts and the second contacts for preventing cross-talk therebetween. Each rear shield member is attached to the back of the corresponding insert subassembly for cooperating with the outer shield member and the inner shield members to complete the shielding of the whole connector assembly.

1 Claim, 9 Drawing Sheets

CONNECTOR ASSEMBLY

BACKGROUND OF THE INVENTION

The present invention relates to an electrical connector assembly adapted to be mounted on a circuit board, and particularly to a modular connector assembly which is well shielded and provides good signal communications capabilities.

DESCRIPTION OF PRIOR ART

As the multi-function trend becomes more popular in the computer industry, the number of electrical connectors used in a computer to interconnect the computer with electronic peripheral equipment increases. Since the space on the mother board in the computer is limited, modular structures have been widely adopted in electrical connectors.

A prior art modular electrical connector is shown in Taiwan Patent Application No. 85103162. The modular connector forms a plurality of mating openings arranged along a longitudinal axis thereof. However, The number of the mating openings as well as the length of the modular connector is limited by the dimensions of the circuit board to which the modular connector is mounted.

Other modular connector types are disclosed in Taiwan Patent Application Nos. 8109709; 86207512 and U.S. Pat. Nos. 5,639,267; 5,562,507. These modular connectors commonly comprise upper and lower rows of mating openings for receiving corresponding mating connectors therein. Each row of mating openings is arranged along a longitudinal axis, allowing the modular connector to engage with more mating connectors by more efficiently using the limited space on the circuit board.

However, the shielding of these modular connectors normally consists of only one or two outer shell(s) enclosing an entire housing. Since the terminals in the modular connector commonly transmit high frequency signals therethrough, undesired cross-talk is created between the terminals within the same connector. Thus, signal transmissions through the modular connector are adversely affected.

As shown in U.S. Pat. No. 5,531,612, a modular connector assembly provides an additional mid-shield positioned between corresponding lower and upper inserts for reducing cross-talk interference therebetween. However, assembling this connector assembly is very involved since it includes a plurality of lower and upper inserts each received in a corresponding accommodating chamber, a plurality of terminals respectively received in the lower and upper inserts, front and rear shield members and the mid-shield. Furthermore, the steps required to assemble the connector are very tedious since they induce so many parts which need to be assembled in a specific order.

Hence, an improved modular connector is desired both to provide effective shielding and to simplify the assembly process.

BRIEF SUMMARY OF THE INVENTION

A first object of the present invention is to provide a well-shielded connector assembly which protects inserted connectors from both external and internal electromagnetic interference.

A second object of the present invention is to provide an electrical connector assembly having a plurality of modular subassemblies which can be conveniently and quickly fixed into the connector assembly, thereby simplifying the assembly process.

A third object of the present invention is to provide an electrical connector assembly which can be conveniently secured to a metallic panel of a computer enclosure thereby gaining the shielding and grounding benefits of connection to the panel.

An electrical connector assembly in accordance with the present invention comprises an outer shield member and a plurality of insert subassemblies received in the outer shield member. A shielding system is provided to include the outer shield member, a plurality of rear shield members attached to the corresponding insert subassemblies, and a plurality of inner shield members respectively fixed in the corresponding insert subassemblies. The outer shield member defines a plurality of accommodating chambers arranged in upper and lower rows for receiving the insert subassemblies. Each insert subassembly includes a base member, a lower contact module containing a plurality of first contacts, the inner shield member, an upper contact module containing a plurality of second contacts, a positioning member and a rear shield member. Each inner shield member is positioned between the first contacts and the second contacts for preventing cross-talk therebetween. Each rear shield member is attached to the back of the corresponding insert subassembly for cooperating with the outer shield member and the inner shield members to complete the shielding of the whole connector assembly.

Other objects, advantages and novel features of the invention will be come more apparent from the following detailed description when taken in conjunction with the accompanying drawings.

DETAILED DESCRIPTION OF THE INVENTION

Figure 1:
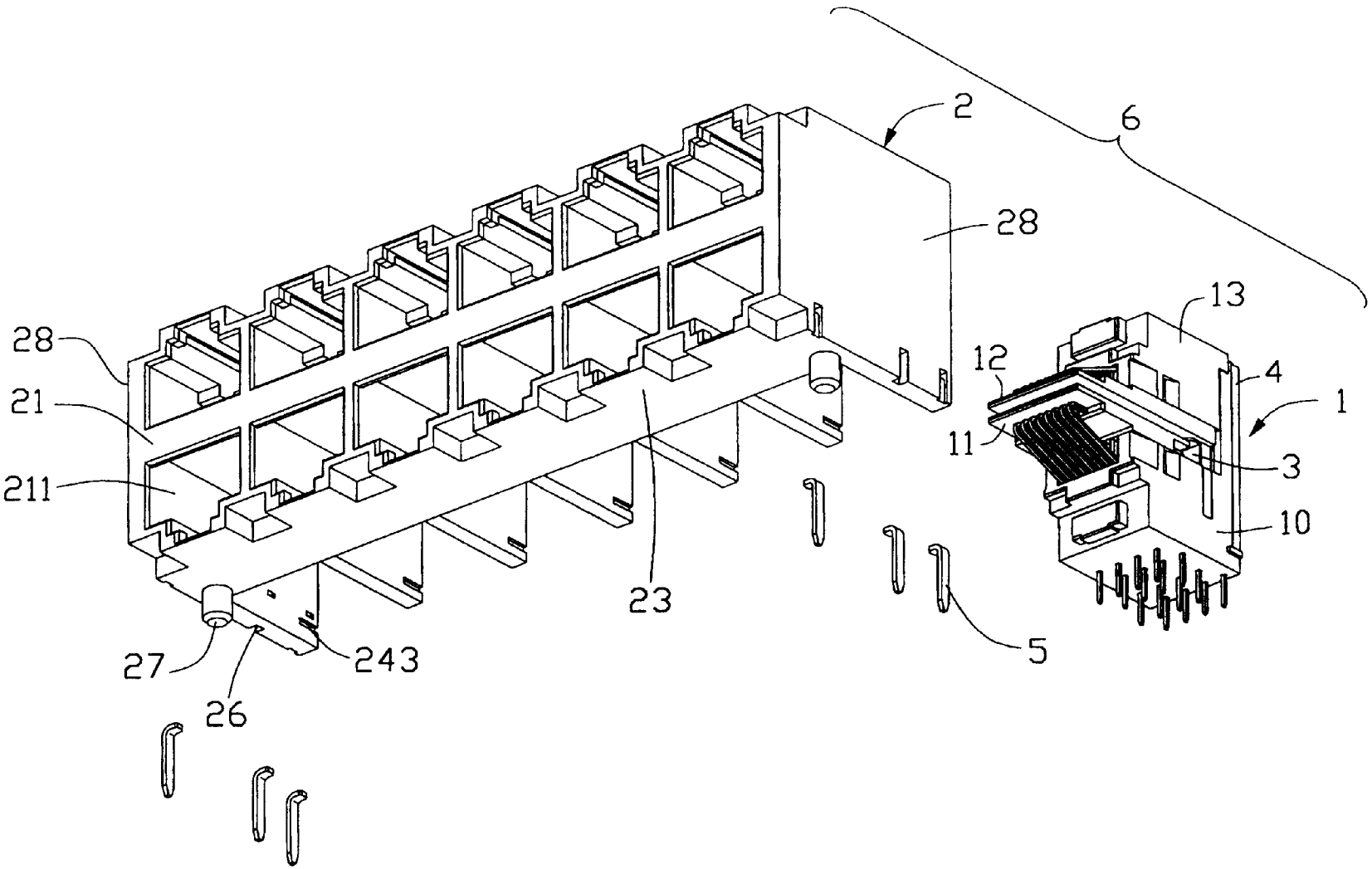
FIG. 1 is an exploded view of a connector assembly in accordance with a first embodiment of the present invention.
Figure 2:
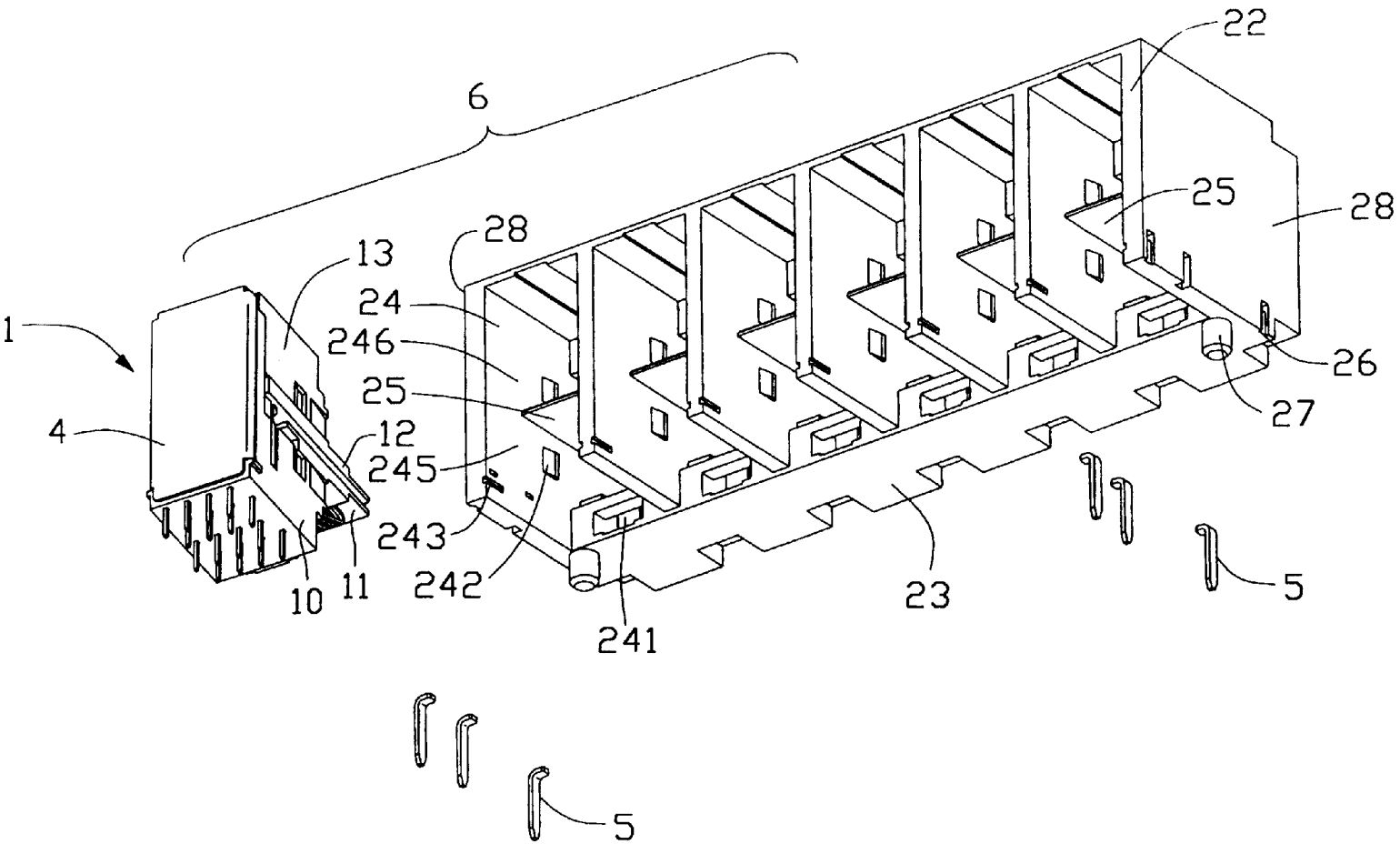
FIG. 2 is another exploded view of the connector assembly of FIG. 1 viewed from another aspect.

Referring to FIGS. 1 and 2, an electrical connector assembly 6 in accordance with a first embodiment of the present invention comprises an outer shield member 2, a plurality of insert subassemblies 1 received in the outer shield member 2 and a plurality of grounding members 5 fixed on the outer shield member 2. Each insert subassembly 1 comprises a base member 10, an upper contact module 12, an inner shield member 3, a lower contact module 11, a positioning member 13 and a rear shield member 4.

A shielding system (not labeled) for the connector assembly 6 includes the outer shield member 2, the rear shield members 4 attached to the corresponding insert subassemblies 1, and the inner shield members 3 fixed within the corresponding insert subassemblies 1.

The outer shield member 2 defines a plurality of accommodating chambers 24 comprising upper and lower accommodating chambers 246, 245, which are arranged in upper and lower rows. Each row of the upper and lower accommodating chambers 246 and 245 extends along a longitudinal axis of the connector assembly 6. Each accommodating chamber 24 extends from a front wall 21 to a rear wall 22 of the outer shield member 2 and communicates with a corresponding pair of mating openings 211 defined in the front wall 21 of the outer shield member 2. The upper row of the mating openings 211 is a mirror image of the lower row of the mating openings 211. A spacing board 25 extends from the front wall 21 toward the rear wall 22 within each accommodating chamber 24 and separates the upper and lower accommodating chambers 246 and 245. Each upper accommodating chamber 246 communicates with a corresponding lower accommodating chamber 245 at rear portions near the rear wall 22.

A pair of engaging projections 242 is formed on each opposite inner surface of each accommodating chamber 24 for engaging with the corresponding insert subassembly 1. A pair of engaging slits 243 is defined in the bottom edges of opposite inner surfaces of each accommodating chamber 24 for engaging with the corresponding insert subassembly 1. A positioning cavity 241 is defined in an inner surface of the front wall 21 in each upper and lower accommodating chamber 246 and 245 for positioning the corresponding insert subassembly 1. A plurality of engaging apertures 26 is defined in the bottom edge of each side wall 28 for securing the grounding members 5. Each conductive grounding member 5 is substantially L-shaped and secured with the outer shield member 2 via engagement with the corresponding engaging aperture 26 for electrical connection with a circuit board (not shown) thereby grounding the outer shield member 2. A pair of posts 27 downwardly extends from a bottom 23 of the outer shield member 2 for connecting with the circuit board.

Figure 3:
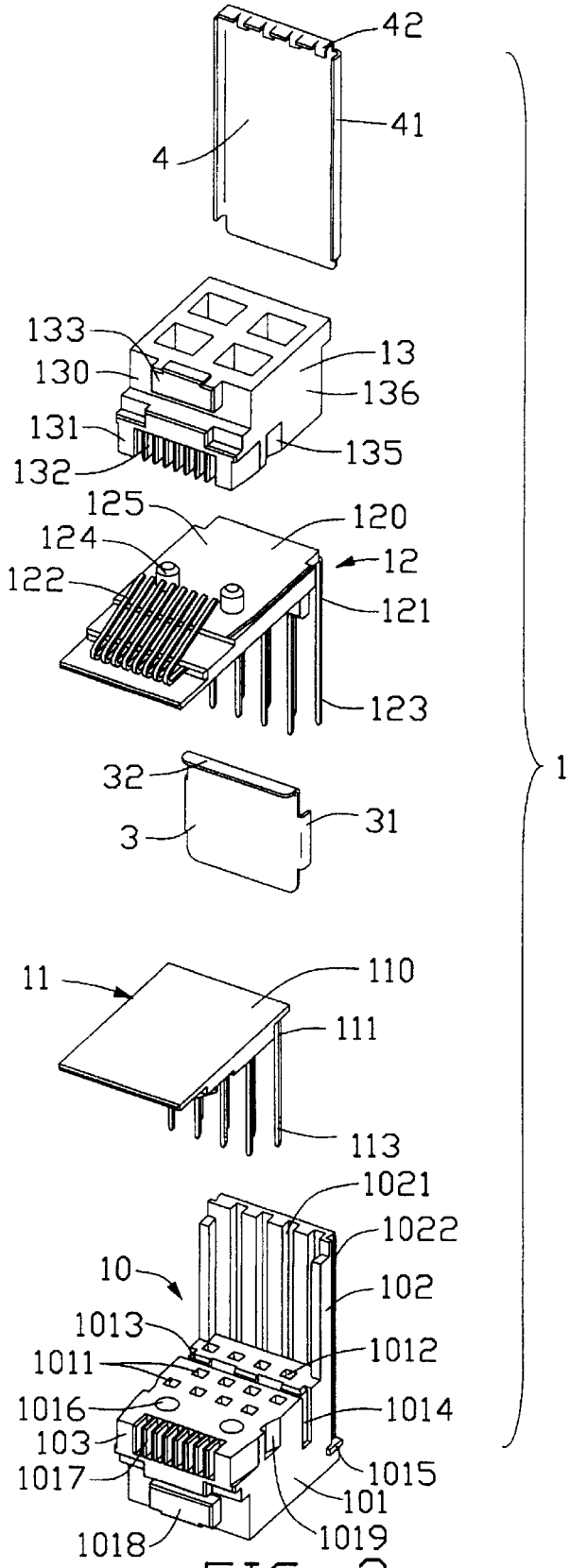
FIG. 3 is an exploded view of an insert subassembly of the connector assembly of FIG. 1.
Figure 4:
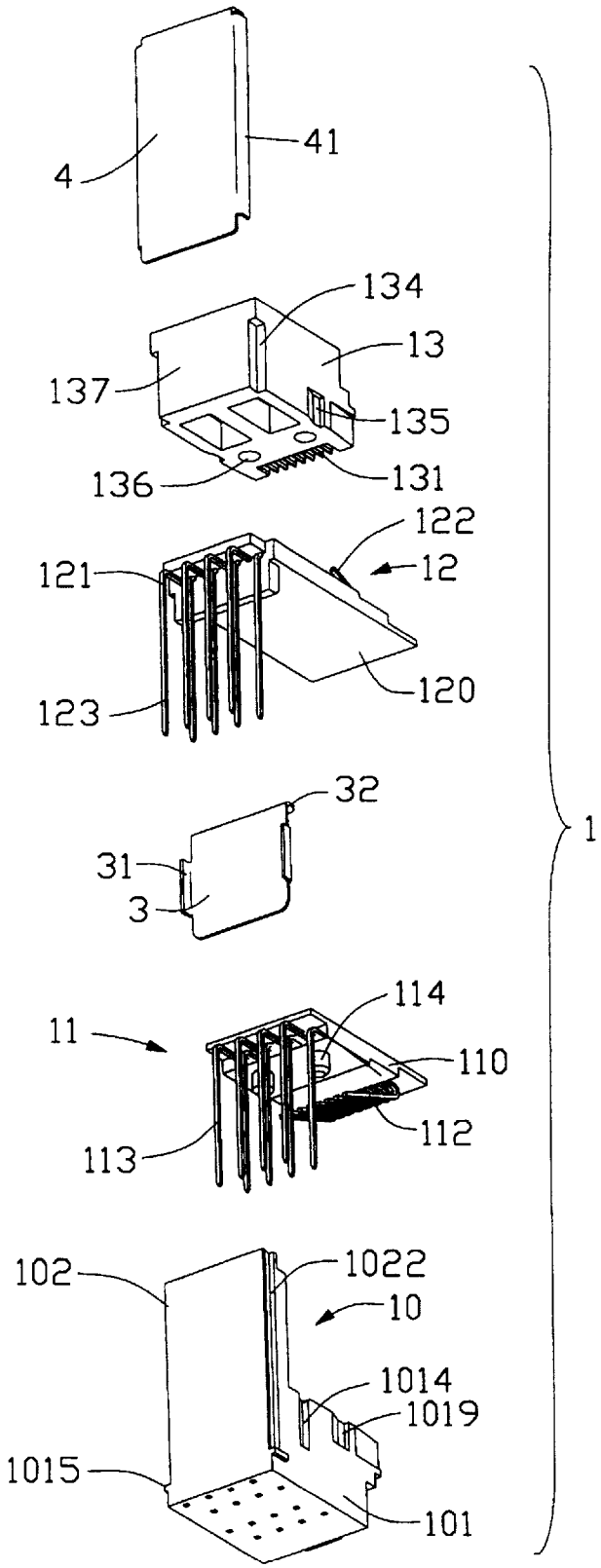
FIG. 4 is another exploded view of the insert subassembly of FIG. 3.

Referring further to FIGS. 3 and 4, each insert subassembly 1 includes a base member 10, a lower contact module 11 containing a plurality of first contacts 111, the inner shield member 3, an upper contact module 12 containing a plurality of second contacts 121, a positioning member 13 and a rear shield member 4. Each inner shield member 3 is positioned between the first contacts 111 and the second contacts 121 for preventing cross-talk therebetween. Each rear shield member 4 is attached to the back of the corresponding insert subassembly 1 for cooperating with the outer shield member 2 and the inner shield members 3 to complete shielding of the whole connector assembly 6.

The base member 10 is substantially L-shaped and comprises a horizontal portion 101 and a vertical portion 102. The vertical portion 102 defines a plurality of grooves 1021 for positioning a rear row of the connecting sections 123 of the corresponding second contacts 121. A pair of recessed steps 1022 is formed on opposite sides of the vertical portion 102 for engaging with the rear shield member 4.

The horizontal portion 101 forms a recess 1014 for receiving the corresponding inner shield member 3. A plurality of projections 1013 inwardly projects from opposite inner surfaces of the recess 1014 for abutting against the corresponding inner shield member 3. A comb section 103 is formed on an end of the horizontal portion 101 opposite the vertical portion 102. A plurality of spaced channels 1017 is defined in the comb section 103 for receiving mating sections 112 of the corresponding first contacts 111. A positioning protrusion 1018 is formed under the comb section 103 for engaging with the corresponding positioning cavity 241 of the outer shield member 2.

A plurality of first positioning openings 1011 is defined in the horizontal portion 101 for positioning corresponding connecting sections 113 of the first contacts 111. A plurality of second positioning openings 1012 is defined proximate the vertical portion 102 for positioning a front row of the connecting sections 123 of the second contacts 121. A pair of positioning holes 1016 is defined adjacent to the first positioning openings 1011 for engaging with the lower contact module 11. A pair of step grooves 1019 is respectively defined on opposite side walls of the horizontal portion 101 for engaging with the engaging projections 242 of the outer shield member 2. A pair of tabs 1015 is formed on the side walls opposite the comb section 103 for engaging with the engaging slits 243 of the outer shield member 2.

The lower contact module 11 comprises a first housing 110 and the plurality of first contacts 111 which are integrally insert molded with the first housing 110. Each first contact 111 has a connecting section 113 vertically extending from the first housing 110, a securing section (not shown) received in the first housing 110 and a mating section 112 being curved toward the connecting section 113. When the lower contact module 11 is assembled to the base member 10, the connecting sections 113 of the first contacts 111 engage within the corresponding first positioning openings 1011 of the base member 10, the mating sections 112 extend into the corresponding spaced channels 1017 of the comb section 103, and the first positioning legs 114 are positioned within the corresponding positioning holes 1016 of the base member 10. Thus, the lower contact module 11 is fixed with the base member 10.

Each inner shield member 3 forms a pair of wings 31 laterally bending from the inner shield member 3 and a top flange 32 curved in a direction opposite to the wings 31. When the inner shield member 3 is inserted into the recess 1014 of the base member 10, the wings 31 abut against the side walls of the horizontal portion 101 while the top flange 32 upwardly extends out of the recess 1014 and abuts against an edge of the upper face of the first housing 110 of the lower contact module 11. Further, the projections 1013 interferentially abut against the inner shield member 3 thereby securing the inner shield member 3 in the recess 1014.

The configuration of each upper contact module 12 is substantially the same as that of the lower contact module 11 except that the mating sections 122 of the second contacts 121 are curved opposite the connecting sections 123 thereof. A pair of second positioning legs 124 is formed on an upper face 125 of the second housing 120 for engaging with the positioning member 13. After the upper contact module 12 is assembled with the base member 10, the connecting sections 123 of the second contacts 121 engage within the corresponding grooves 1021 of the base member 10.

The positioning member 13 forms a positioning bump 133 on a front end 130 thereof for engaging with the corresponding positioning cavity 241 of the outer shield member 2. A comb portion 131 is formed under the positioning bump 133 and defines a plurality of spaced channels 132 for receiving the mating sections 122 of the corresponding second contacts 121. A pair of step grooves 135 is defined in the bottom edges of opposite side walls 136 for engaging with the corresponding engaging projections 242 of the outer shield member 2. A pair of step grooves 134 is defined in the corners where a rear wall 137 meets the side walls 136 for engaging with the rear shield member 4. A pair of engaging holes 136 is defined in a bottom surface of the positioning member 13 for engaging with the second positioning legs 124 of the upper contact module 12.

The rear shield member 4 is plate-like and comprises a pair of lateral edges 41 and a top edge portion 42. The lateral edges 41 are adapted to engage with the corresponding step grooves 134 of the positioning member 13 and the corresponding recessed steps 1022 of the base member 10, while the top edge portion 42 engages with the rear wall 137 of the positioning member 13 when the rear shield member 4 is fixed to the insert subassembly 1.

Figure 5:
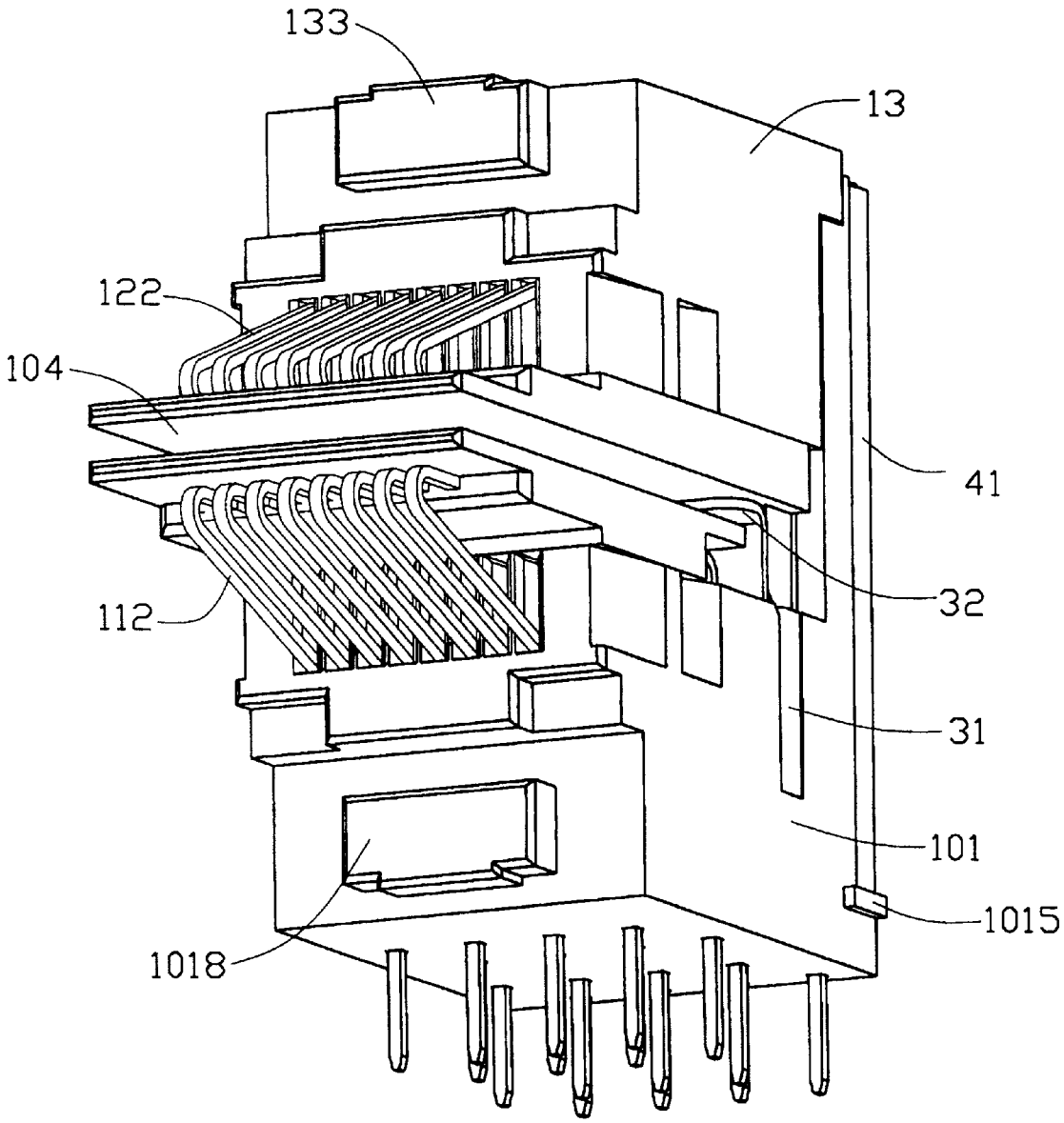
FIG. 5 is an assembled view of the insert subassembly of FIG. 3.

The assembled insert subassembly 1 is shown in FIG. 5. In assembly, the lower contact module 11 is first fixed to the base member 10. The inner shield member 3 is then inserted into the recess 1014 of the horizontal portion 101. The upper contact module 12 is then assembled to the base member 10, and the positioning member 13 is fixed to the base member 10 and the upper contact module 12. Finally, the rear shield member 4 is assembled to the rear of the base member 10 to complete the integral insert subassembly 1. A space 104 is formed between the first housing 110 of the lower contact module 11 and the second housing 120 of the upper contact module 12 for engaging with the outer shield member 2.

Figure 6:
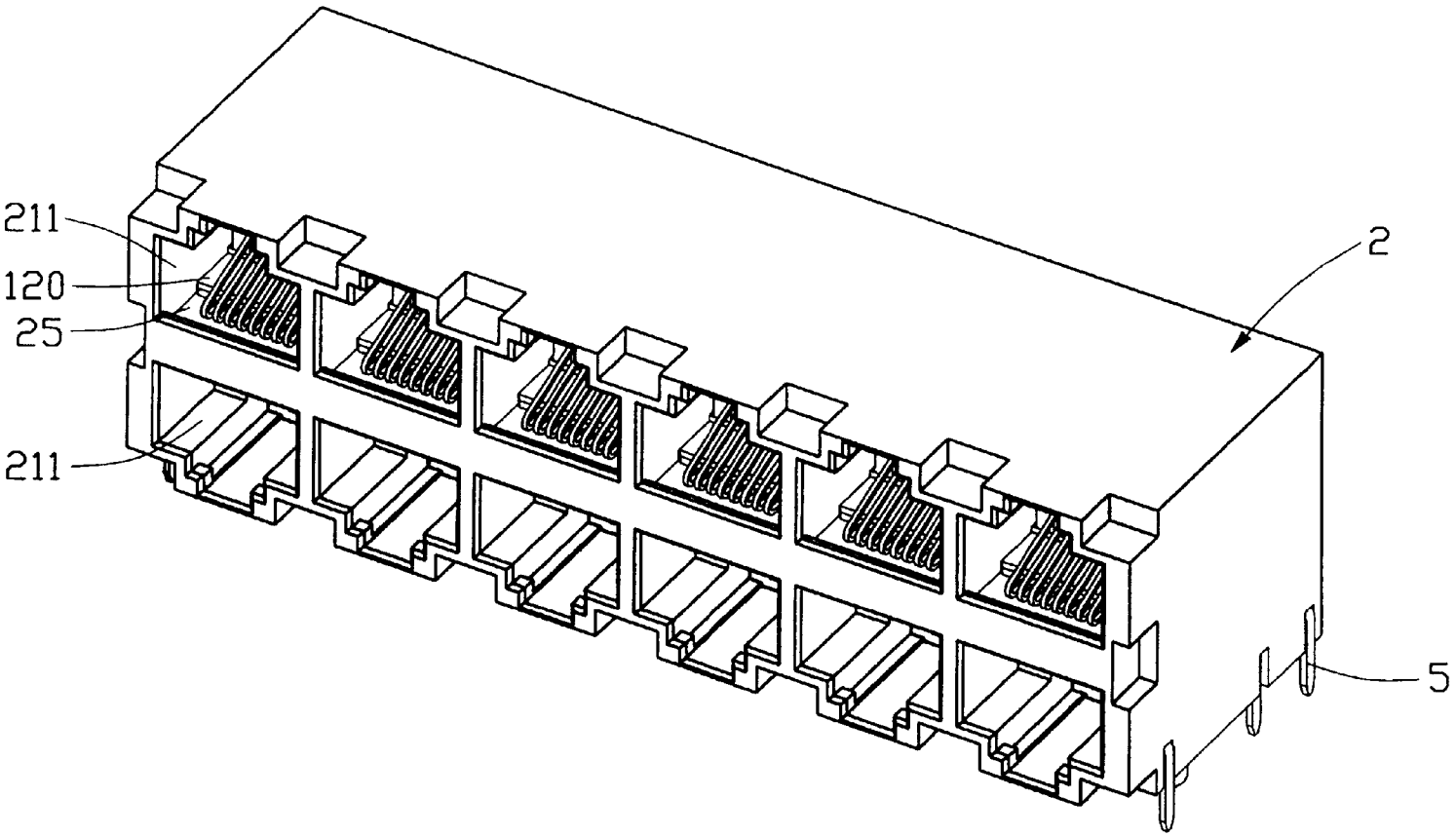
FIG. 6 is a perspective view of the connector assembly of FIG. 1.
Figure 7:
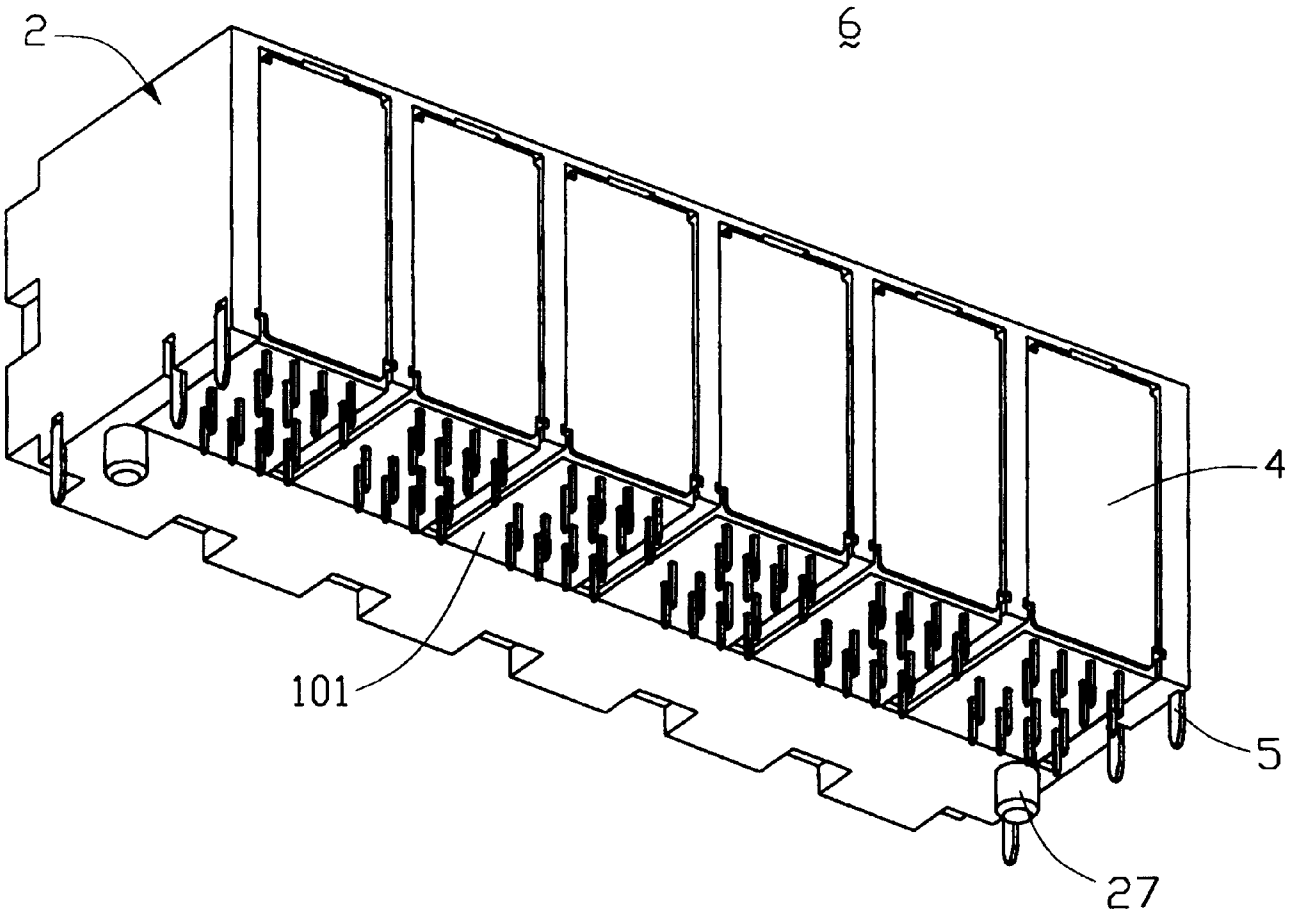
FIG. 7 is another perspective view of the connector assembly of FIG. 1.

Also as shown in FIGS. 6 and 7, each insert subassembly 1 is assembled into the corresponding accommodating chamber 24. The lower contact module 11 of each insert subassembly 1 is received in the lower accommodating chamber 245, while the upper contact module 12 is simultaneously received within the upper accommodating chamber 246. The spacing board 25 is engaged in the space 104 of the insert subassembly 1. The positioning protrusion 1018 of the base member 10 and the positioning bump 133 of the positioning member 13 engage with the positioning cavities 241 of the corresponding accommodating chamber 24. The tabs 1015 of the base member 10 engage with the corresponding engaging slits 243 of the outer shield member 2. Thus, each insert subassembly 1 is firmly secured within the corresponding accommodating chamber 24 of the outer shield member 2.

Figure 8:
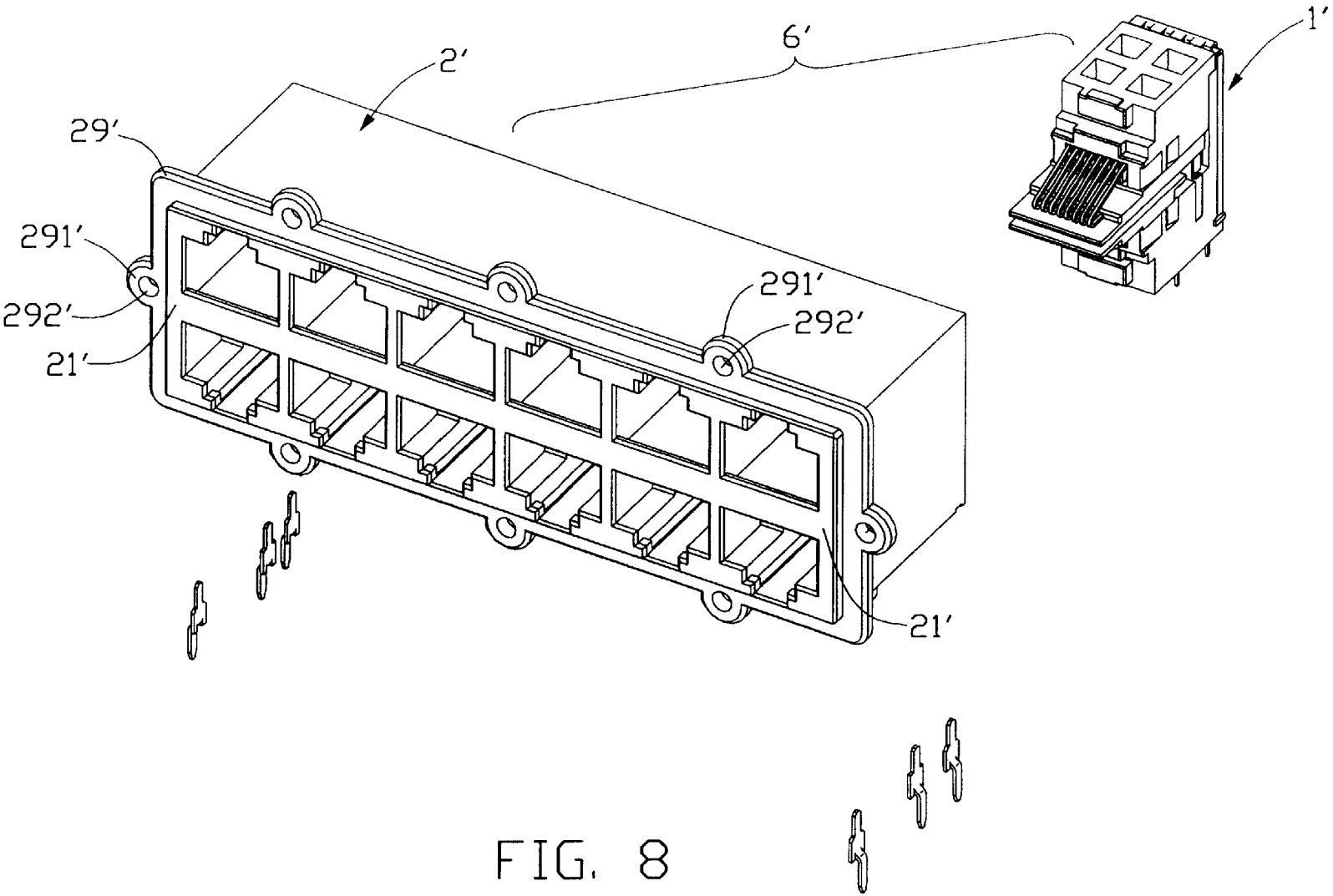
FIG. 8 is an exploded view of a connector assembly in accordance with a second embodiment of the present invention.
Figure 9:
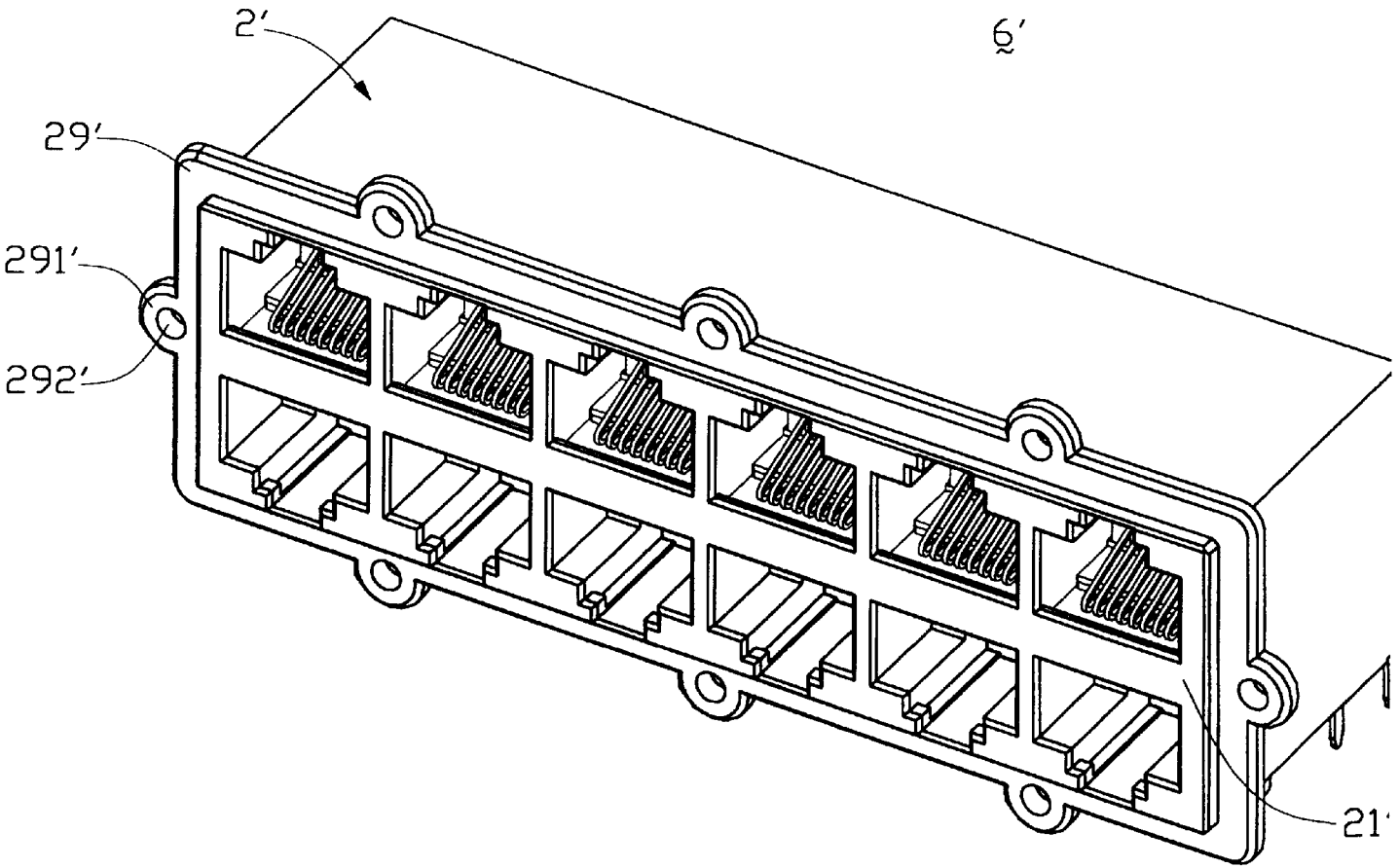
FIG. 9 is an assembled view of FIG. 8.

In a second embodiment, as shown in FIGS. 8 and 9, the connector assembly 6' also comprises an outer shield member 2' and a plurality of insert subassemblies 1' received in the outer shield member 2'. Each insert subassembly 1' is substantially the same as the insert subassembly 1 described above. The outer shield member 2' is essentially the same as the outer shield member 2, except that a plurality of mounting sections 291' is formed on a peripheral flange 29', which is formed around the edges of a front wall 21' of the outer shield member 2'. The peripheral flange 29' of the outer shield member 2' is adapted to abut against a metallic panel of a computer enclosure (not shown), on which the connector assembly 6' is mounted. Each mounting section 291' defines a mounting aperture 292' for securing the connector assembly 6' with the metallic panel by means of screws or other attachment means. The assembly process of the connector assembly 6' is substantially the same as for the connector assembly 6 described in the first embodiment, thus, is not repeated here.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an outer metal shield member forming a plurality of aligned upper and lower accommodating chambers separated by a spacing board, a plurality of aligned mating openings being defined in a front wall of the outer shield member and arranged in upper and lower rows, each mating opening in the upper row communicating with a corresponding upper accommodating chamber and each mating opening in the lower row communicating with a corresponding lower accommodating chamber, each upper accommodating chamber communicating with a corresponding aligned lower accommodating chamber at a rear side opposite the front wall; and a plurality of insert subassemblies being respectively received in corresponding pairs of aligned upper and lower accommodating chambers of the outer shield member, each insert subassembly comprising a base member having a horizontal portion and a vertical portion, a lower contact module secured to the horizontal portion of the base member and securing a plurality of first contacts, a upper contact module mounted to the vertical portion of the base member and securing a plurality of second contacts, an inner metal shield member positioned between the first contacts of the lower contact module and the second contacts of the upper contact module, and a positioning member for positioning the upper contact module, a space being defined between the first and upper contact modules for receiving the spacing board of the outer shield member;

wherein the base member and the lower contact module of each insert subassembly are received within the lower accommodating chamber of the outer shield member, the base member forming a positioning protrusion on an end of the horizontal portion for engaging with a positioning cavity defined in the front wall of the outer shield member, the first contacts of the lower contact module having curved mating sections extending into the lower accommodating chamber and aligning with a corresponding lower mating opening for electrically engaging with a first connector;

and wherein the positioning member and the upper contact module of each insert subassembly are received within a corresponding upper accommodating chamber above and aligned with the lower accommodating chamber which receives the base member and the lower contact module, the second contacts of the contact module having curved mating sections extending into the upper accommodating chamber and aligning with a corresponding upper mating opening for electrically engaging with a second mating connector;

wherein the inner shield member forms a top flange for abutting against an upper face of the lower contact module and a pair of laterally bent wings for abutting against corresponding side walls of the base member;

wherein the horizontal portion of the base member defines a recess for receiving the inner shield member therein;

wherein a plurality of projections inwardly extend into the recess of the horizontal portion of the base member for abutting against the inner shield member;

wherein the horizontal portion of the base member forms a comb section substantially above the positioning protrusion, the comb section defining a plurality of spaced channels for respectively receiving the curved mating sections of the first contacts of the contact module;

wherein the lower contact module comprises a pair of downwardly extending first positioning legs, and wherein a pair of positioning holes is defined in the horizontal portion of the base member for positioning the first positioning legs of the lower contact module;

wherein a plurality of positioning openings is defined in the horizontal portion of the base member, and wherein the first contacts have connecting sections downwardly extending from the lower contact module for engaging within corresponding positioning openings of the base member;

wherein the vertical portion of the base member defines a plurality of vertical grooves, and wherein the second contacts form downwardly extending connecting sections aligned in two rows, one of the two rows of connecting sections of the second contacts engaging with corresponding vertical grooves of the vertical portion of the base member, and the other row of the two rows of connecting sections of the second contacts engaging with a row of positioning openings defined in the horizontal portion of the base member;

wherein a pair of tabs is respectively formed on opposite side walls of the horizontal portion of the base member for engaging with corresponding engaging slits, which are defined in opposite inner surfaces of side walls of corresponding accommodating changers of the outer shield member;

wherein a pair of step grooves is defined on opposite sides of the horizontal portion of the base member for engaging with corresponding engaging projection, which are defined on opposite inner surfaces of side walls of corresponding accommodating chambers of the outer shield member;

wherein the upper contact module forms a pair of legs upwardly extending therefrom, and wherein the positioning member defines a pair of engaging holes in a bottom face for engaging with the legs of the upper contact module;

wherein the positioning member forms a comb portion at an end thereof, the comb portion defining a plurality of spaced channels for receiving corresponding curved mating sections of the second contacts of the upper contact module;

wherein each insert subassembly further comprises a rear shield member, the rear shield member including a pair of lateral edges, and wherein a pair of step grooves is defined in an area between opposite side walls and a rear wall of the positioning member for abutting against the lateral edges of the rear shield member, a pair of recessed steps being formed on opposite sides of the vertical portion of the base member for engaging with the lateral edges of the rear shield member;

wherein each rear shield member forms a top edge portion engaging with the rear wall of the positioning member when the rear shield member is fixed to the insert subassembly;

wherein the positioning member forms a positioning bump on a front end thereof for engaging with a corresponding positioning cavity defined in an inner surface of the front wall of the outer shield member.

* * * * *